US006173254B1

(12) United States Patent
Suzuki

(10) Patent No.: US 6,173,254 B1
(45) Date of Patent: Jan. 9, 2001

(54) RECORDED MESSAGE PLAYBACK SYSTEM FOR A VARIABLE BIT RATE SYSTEM

(75) Inventor: Kunikazu Suzuki, Chiryu (JP)

(73) Assignee: Denso Corporation, Ltd. (JP)

( * ) Notice: Under 35 U.S.C. 154(b), the term of this patent shall be extended for 0 days.

(21) Appl. No.: 09/136,261

(22) Filed: Aug. 18, 1998

(51) Int. Cl.[7] ..... G10L 21/04
(52) U.S. Cl. ..... 704/212; 214/221
(58) Field of Search ..... 704/207, 209, 704/211, 212, 219, 221

(56) References Cited

U.S. PATENT DOCUMENTS

Re. 34,976 * 6/1995 Helferich et al. ..... 379/88
4,864,301 * 9/1989 Helferich ..... 347/110
5,003,576 * 3/1991 Helferich ..... 379/88
5,133,010 * 7/1992 Borth et al. ..... 381/38
5,414,796 * 5/1995 Jacobs et al. ..... 704/221
5,495,555 * 2/1996 Swaminathan ..... 704/207
5,657,420 * 8/1997 Jacobs et al. ..... 704/233
5,737,716 * 4/1998 Bergstrom et al. ..... 704/202
5,796,757 * 8/1998 Czaja ..... 371/146

* cited by examiner

*Primary Examiner*—Tālivaldis I. Šmits
*Assistant Examiner*—Susan Wieland
(74) *Attorney, Agent, or Firm*—Fish & Richardson PC

(57) ABSTRACT

A greeting message is recorded and stored at a first rate for use in a system. The system includes a command indicating the desired rate to be used in coding on the system. The greeting message is then reconstructed and re-encoded based on the desired rate. Alternatively, the greeting message may be stored in a plurality of rate formats. The appropriate rate format may then be selected by the system.

7 Claims, 1 Drawing Sheet

RECORDED MESSAGE PLAYBACK SYSTEM FOR A VARIABLE BIT RATE SYSTEM

BACKGROUND

Certain mobile phone systems use a memory unit for storing a voice message from a user such as an outgoing voice message. The user can store their personalized voice message in that memory. The message is played back as the user's personalized message. That memory unit has a limited size. However, the user often wants to store a longer message.

Speech is often compressed before storing in this memory. Speech can be compressed using a well-known voice coder or vocoder system. Vocoders are well known in the art and compresses the speech by using well-known models. These models typically compress the speech based on its different parts: silence, noise and actual utterances. Codebooks are used to compress the different components of the speech.

A well-known and often-used system compresses the speech using variable rate coding. Several different standards exist. The Enhanced Variable Rate Coding ("EVRC") from Telecommunications Industries Association (TIA) is one. Cellular carriers in Japan including DDI and IDO have decided to adopt EVRC. Qualcomm also has a system called the Qualcomm Code Excluded Linear Predictive Coder ("QCELP").

A basic description of such variable rate codecs is found in U.S. Pat. No. 5,495,555, the disclosure of which is incorporated by reference to the extent necessary for proper understanding.

All of these systems operate an algorithm that determines an optimal encoding rate to use depending on the voice power.

The rate can be encoded at one-eighth maximum rate for much of the signal. Other parts of the signal can be encoded at one-quarter, one-half, and/or full voice power as shown. Again, the algorithm determines this coding. By reducing the maximum voice power that is encoded, the system saves on bandwidth.

SUMMARY OF THE INVENTION

The variable rate system codes the greeting message based on the amount of voice power in the greeting. However, at certain times, base station may require a rate reduction which limits the maximum full rate of the system. This rate reduction is detailed in various standards, including EIA/TIA/IS-127. One common reason for the command for rate reduction is too much traffic on the system. The system responds by changing the maximum duty cycle of the frames. Hence, the system carries less data during these times.

The inventor recognized that if the greeting message is already recorded at a different rate than that specified by the system, a conflict may exist. For example, if the message has portions recorded at full rate, there might be difficulties if the base station commands half-rate maximum.

BRIEF DESCRIPTION OF THE DRAWINGS

These and other aspects of the invention will now be described with reference to the attached drawings, in which.

DESCRIPTION OF THE PREFERRED EMBODIMENTS

To solve the problems noted above, the system as described herein enables the greeting message to be played even when the overall controlling system has specified any aspect of the system coding that differs from the coding at which the greeting was recorded.

Figure 1:
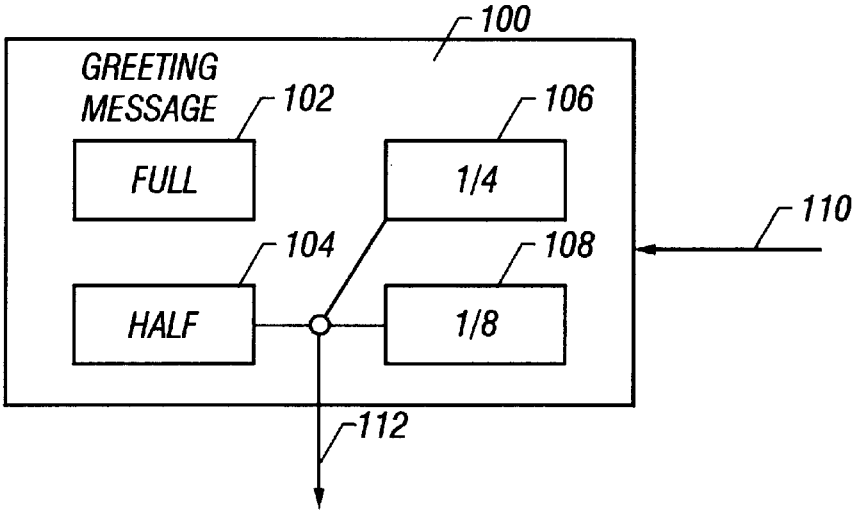
FIG. 1 shows an embodiment of the greeting memory with multiple versions of the memory information being stored at different resolutions.

A first embodiment for avoiding these problems is shown in FIG. 1. The greeting memory 100 includes stored therein four different versions of the greeting. The greetings are played over a cellular system, more preferably an IS-95 cellular system. Each of these different versions is recorded using a different aspect of system coding.

Figure 2:
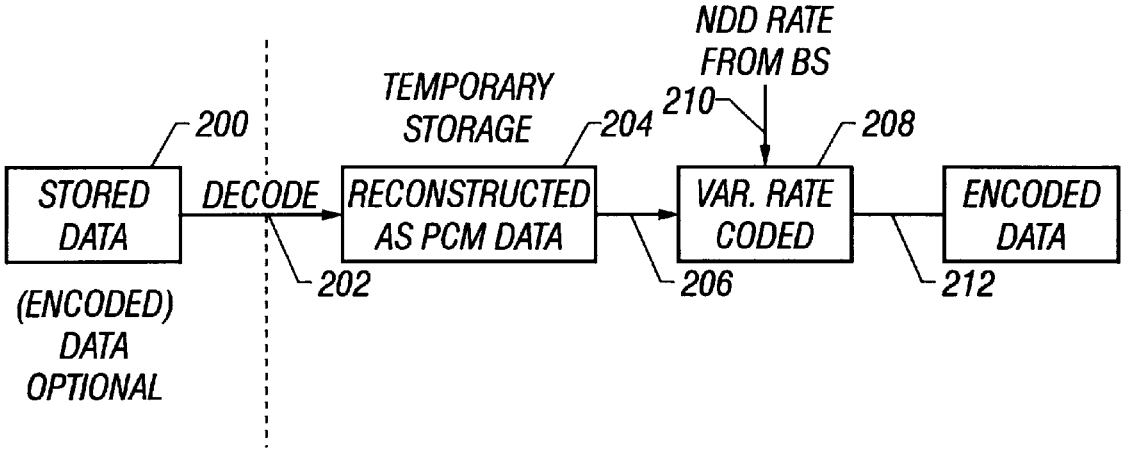
FIG. 2 shows a block diagram of the greeting data reconstruction system.

FIG. 2 shows the memory storing the full-rate greeting 102, a half-rate greeting 104, a quarter-rate greeting 106, and an eighth-rate greeting 108. The command from the controlling system is shown as being input as 110. This command, if inactive, allows the full-rate greeting to be selected as the outgoing greeting 112. However, if the bandwidth of the system is limited due to external characteristics, a different one of the greetings is selected.

This system obviously has the drawback of requiring extra information to be stored. However, that extra information is of a lower overall rate than full maximum. The extra information to be stored in the above embodiment is $1+\frac{1}{2}+\frac{1}{4}+\frac{1}{8}\approx 1.875$*the original size of the message. Of course, not all the resolutions need to be stored.

A second embodiment is shown in FIG. 2. In this system, the greeting data 200 is typically stored data that is read out over a channel. The data 200 is then decoded at 202 to form reconstructed PCM data 204. The PCM data is then re-encoded at 206 by a variable rate codec 208.

Variable rate codec 208 receives as input the maximum rate command from the base station. Hence, the re-encoded data 212 is re-encoded according to the maximum rate from the base station.

Any desired format could be used for storage in this technique, since the output data 206 is in standard form.

Although only a few embodiments have been described in detail above, other embodiments are contemplated by the inventor and are intended to be encompassed within the following claims. In addition, other modifications are contemplated and are also intended to be covered.

What is claimed is:

1. A system for playing a greeting in a variable rate vocoder system, comprising:

a reconstruction device, which decodes a message in a compression scheme and reconstructs the message information therefrom as a reconstructed message; and a variable rate codec, connected to receive a desired rate command from an overall system commanding element, and to receive said reconstructed message and to re-code said reconstructed message according to said desired rate command.

2. A system as in claim 1, wherein said compression scheme has a different rate than said desired rate command.

3. A system as in claim 1, wherein said reconstructed message is in PCM form.

4. A method of playing a message, comprising:

receiving a command from an overall system commanding element regarding a first rate to be used in coding on the system; and playing a message stored at a second rate according to said command at the first rate.

5. A method as in claim 4, wherein said first rate is different than said second rate.

6. A method as in claim 4, wherein said playing comprises, playing back a stored message at said second rate, re-coding the message to said first rate, and playing the recoded message.

7. A method of operating a message system in a telephone system, comprising:

storing a message in a plurality of rate formats receiving a command from an overall system commanding element regarding a desired rate to be used in coding on the system;

selecting one of the plurality of rate formats based on the desired rate; and playing the message stored in the selected one of the plurality of rate formats.

* * * * *